US007038434B1

(12) United States Patent
Brekelmans et al.

(10) Patent No.: US 7,038,434 B1
(45) Date of Patent: May 2, 2006

(54) VOLTAGE REGULATOR

(75) Inventors: Johannes Hubertus Antonius Brekelmans, Eindhoven (NL); Gerben Willem De Jong, Eindhoven (NL)

(73) Assignee: Koninklijke Phiips Electronics N.V., Eindhoven (NL)

( * ) Notice: Subject to any disclaimer, the term of this patent is extended or adjusted under 35 U.S.C. 154(b) by 0 days.

(21) Appl. No.: 10/523,730

(22) PCT Filed: Jul. 21, 2003

(86) PCT No.: PCT/IB03/03292

§ 371 (c)(1),
(2), (4) Date: Feb. 4, 2005

(87) PCT Pub. No.: WO2004/015512

PCT Pub. Date: Feb. 19, 2004

(30) Foreign Application Priority Data

Aug. 8, 2002 (EP) ..... 02078285

(51) Int. Cl.
*G05F 1/40* (2006.01)

(52) U.S. Cl. ..... 323/282

(58) Field of Classification Search ..... 323/265, 323/282, 283, 284, 351
See application file for complete search history.

(56) References Cited

U.S. PATENT DOCUMENTS

| | | | | |
|---|---|---|---|---|
| 5,434,535 | A * | 7/1995 | Tomasini et al. | 327/552 |
| 5,631,598 | A * | 5/1997 | Miranda et al. | 327/540 |
| 5,686,820 | A * | 11/1997 | Riggio, Jr. | 323/273 |
| 5,982,226 | A * | 11/1999 | Rincon-Mora | 327/541 |
| 6,188,211 | B1 * | 2/2001 | Rincon-Mora et al. | 323/280 |
| 6,246,221 | B1 * | 6/2001 | Xi | 323/280 |
| 6,373,233 | B1 * | 4/2002 | Bakker et al. | 323/282 |
| 6,975,099 | B1 * | 12/2005 | Wu et al. | 323/280 |

* cited by examiner

*Primary Examiner*—Adolf Berhane
(74) *Attorney, Agent, or Firm*—Michael J. Ure

(57) ABSTRACT

A low dropout voltage regulator comprising a series-regulating element (T1) between an input (I) and an output (O) of the voltage regulator, and a differential input error amplifier (1) having a first output (O1) coupled to a control input of the series-regulating element (T1), characterized in that the error amplifier (1) further comprises a second output (O2) coupled to the output (O) via a high-pass filter (5, C1, R1).

9 Claims, 4 Drawing Sheets

VOLTAGE REGULATOR

The invention relates to a voltage regulator comprising a series-regulating element between an input and an output of the voltage regulator, and a differential input error amplifier having a first output coupled to a control input of the series-regulating element.

Low dropout voltage regulators are widely used building blocks in almost any electronic application. They adapt an external power supply to the needs of the supplied circuit. In portable applications as in mobile phones a main requirement for the voltage regulator is a low dropout voltage and a good stability over a large range of capacitive loads.

Figure 7:
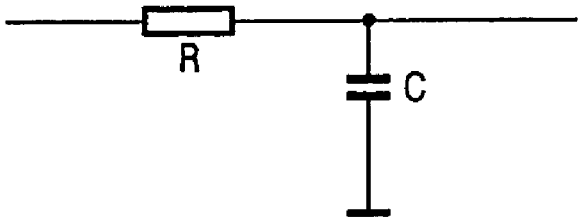

In applications requiring read/write operations on an optical disk as CD, DVD, Blue-ray Disk (BD), a photo diode integrated circuit (PDIC) is provided. In such an IC, the photo diode detector, supplied from a photo diode supply filter, is followed by a programmable amplifier. In prior art Photo Diode ICs, the photo diode supply filter comprises a passive first order RC low-pass filter as shown in FIG. 7. The resistor R is adapted to the current supply demands of the photo diode and therefore, depends on the received laser light intensity. To keep a voltage drop across resistor R sufficiently low, the resistor value is adapted depending on current requirement (light intensity). The current requirement is approximately inversely proportional with the gain of a pre-amplifier. Consequently, the cut-off frequency of the filter $f_{.3dB}=1/(2\pi RC)$ changes depending on the current requirement. At low frequencies (far below $f_{.3dB}$) the output impedance of the filter is determined by R.

High intensity light pulses are used to write on an optical disc (CD, DVD or BD (Blu-ray Disc)). The PDIC is used to monitor the write process. Directly following a high intensity 'Write' laser pulse, a low intensity read out is needed, see FIG. 6. A write level WL of the photo current PC during write period W is about 80x a read level RL during read period R. The low intensity read outs contain mostly servo control information, including a wobble signal. The PDIC photo diode and amplifiers have to recover from the write pulse fast enough to provide sufficient accuracy in subsequent read operation. This settling time is governed by bandwidth and flatness of response as function of frequency, both in terms of amplitude and phase. These requirements also translate to the output impedance of the supply filter. The simple filter shown in FIG. 7 is not fit for use in read/write operations with such stringent settling requirements. Based on FIG. 6 it can be derived that for the filter shown in FIG. 7 having a capacitor of 40 pF, a resistance of the resistor should not exceed 60 ω. However, with these values the required filter suppression associated with the high gain settings are no longer met.

U.S. Pat. No. 6,373,233 describes a low dropout voltage regulator with improved stability for all capacitive loads. The low dropout voltage regulator comprises a series controlled p-MOS transistor controlled by a differential input error amplifier. An output of the error amplifier is coupled to an output terminal of the series controlled p-MOS transistor via a series connection between a capacitor and a resistor. A feedback from the output of the low dropout voltage regulator to an input of the error amplifier is provided, too. The series controlled p-MOS transistor acts as an integrator and consumes a too large amount of phase margin to allow low output impedance also at high frequencies. Hence, the low drop voltage regulator presented in that prior art patent cannot provide low output impedance at high frequencies and therefore it is not suitable in applications involving read/write processes as CD, DVD and BD.

It is therefore an object of the present invention to provide an improved voltage regulator.

In accordance with the invention this is achieved in a voltage regulator as described in the first paragraph, characterized in that the error amplifier further comprises a second output coupled to the output via a high-pass filter. DC and low frequencies are filtered by the series-regulating element while relatively high frequencies are filtered by the high-pass filter. Both branches are controlled in parallel by the differential input error amplifier. The circuit allows a relatively lower voltage drop between the input signal and the output signal.

In an embodiment of the invention a first low-pass filter is coupled between input and an input terminal of the series-regulating element. It is experimentally determined that the first low-pass filter is still advantageous for obtaining good overall filter suppression.

The first low-pass filter may comprise a first plurality of resistors connected in series, the first plurality of resistors being coupled to a first plurality of respective switches for modifying a time constant of the first low-pass filter. A time constant of a first order low-pass filter is proportional to a product between the resistor value and the capacitor value of the filter. Modifying the value of the resistor in the filter results in a modification of the time constant. A cut-off frequency of the filter is inverse proportional with the product between the capacitor and the resistor values and therefore, the cut-off frequency is also changed when the resistor value is changed.

In an embodiment of the invention a first input of the error amplifier is coupled to the input of the regulator through a second low-pass filter. The second low-pass filter may comprise a series coupling of a drop voltage source, a second resistor and a second capacitor. The reference of the error amplifier is the supply voltage, reduced with a small DC voltage and low-pass filtered by the second capacitor and the second resistor. The drop voltage could be obtained as e.g. a bipolar junction transistor connected as a diode or as a fixed bias current through a resistor. It could be pointed out here that the reference voltage could be also a supply-voltage independent voltage source as in stabilization circuits.

In another embodiment of the invention the series-regulating element comprises a plurality of series-regulating elements coupled to a respective second plurality of selectable resistors. The second plurality of selectable resistors is implemented as field effect transistors coupled in pairs. Each pair comprises a series connection of main current channels of two transistors coupled between the input and an output of the first amplifier or between an output of the first low-pass filter and the output of the first amplifier. When a selectable resistor pair is selected the output of the low dropout voltage regulator is inputted to a specific selectable series-regulating element for adapting to load requirements for the low dropout voltage regulator.

In another embodiment of the invention the low dropout voltage regulator is used in an optical detector/amplifier for supplying one or more photo diodes coupled to variable gain amplifiers. Having a relative fast settling time and a relative large bandwidth, the low dropout voltage regulator according to the invention is a better solution for applications in which a photo diode receives an optical signal from an optical data carrier. The variable gain amplifier preferably comprises a plurality of cascaded-connected controllable amplifiers for obtaining a sufficient amplification of the signal generated by the photo diode.

Figure 1:
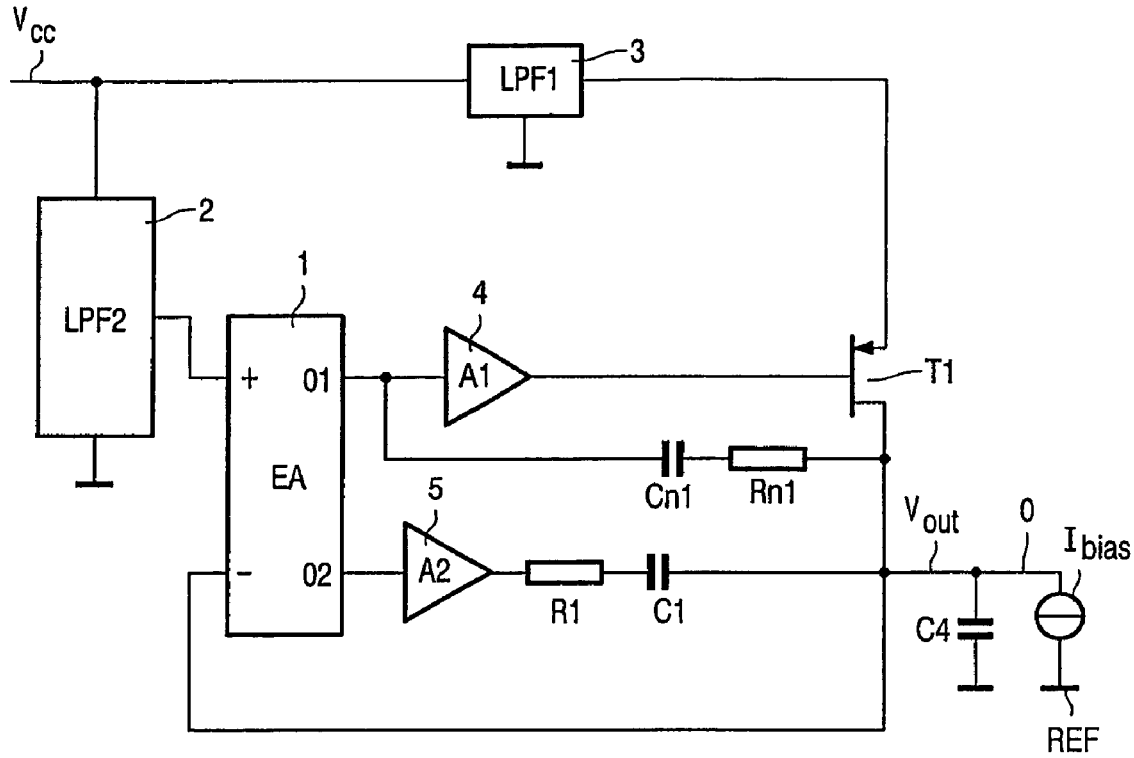
Figure 2:
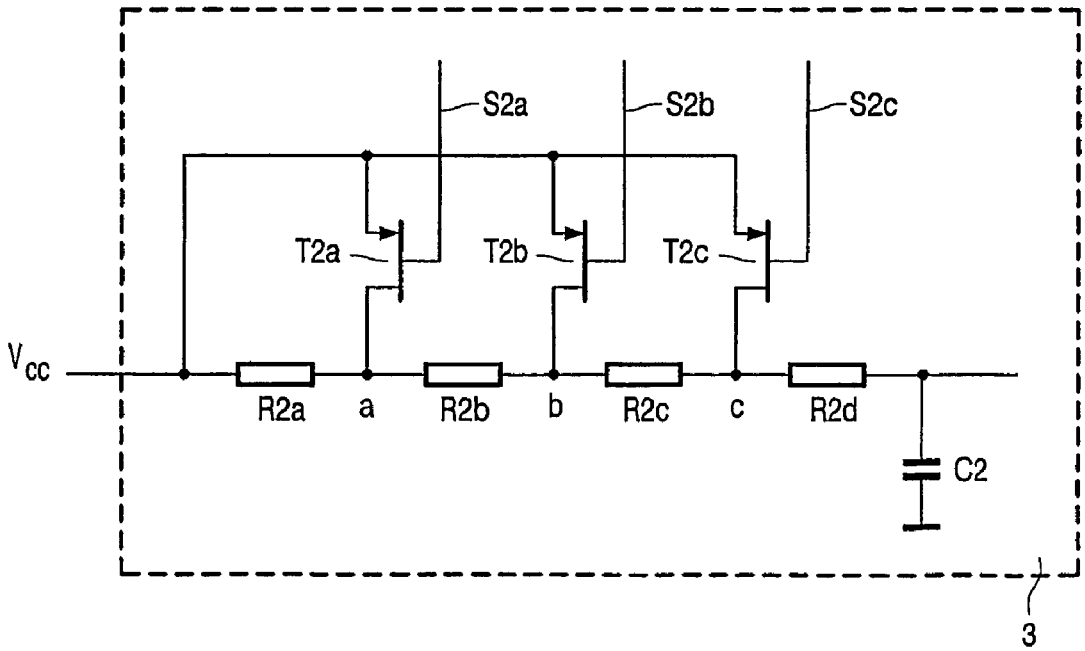
Figure 3:
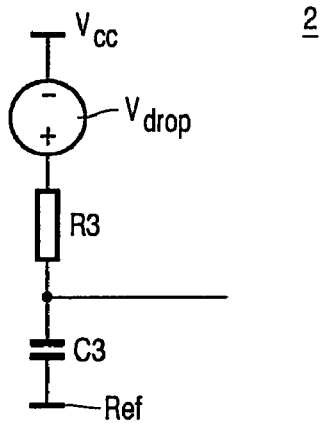
Figure 4:
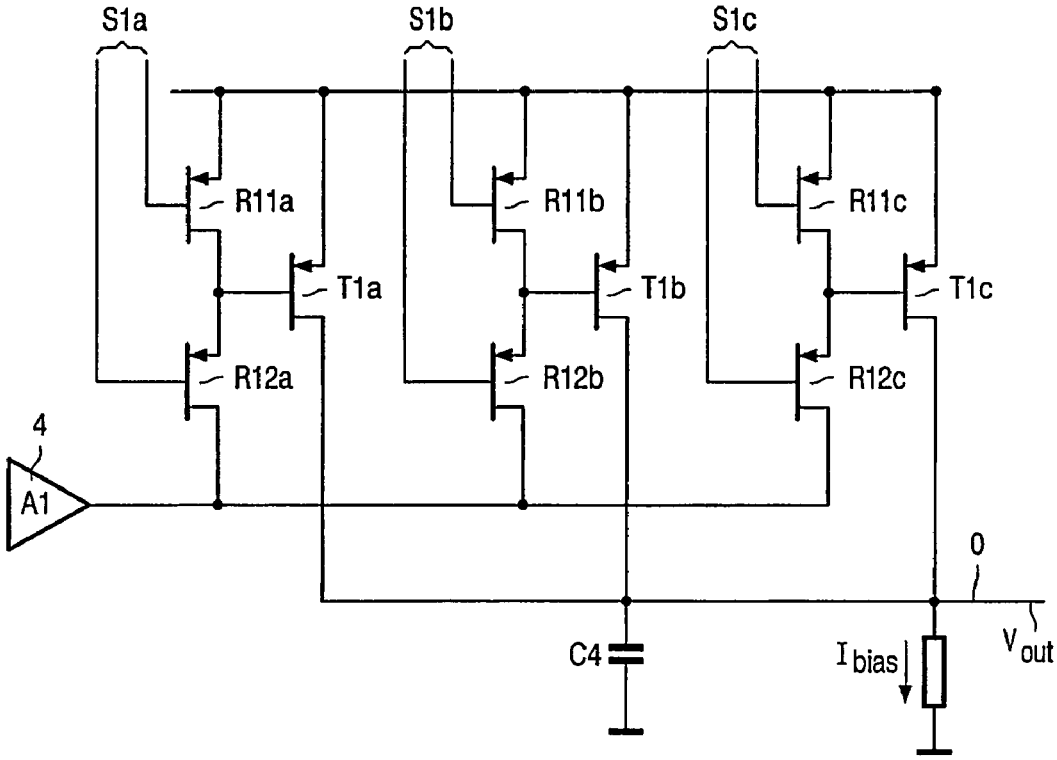
Figure 5:
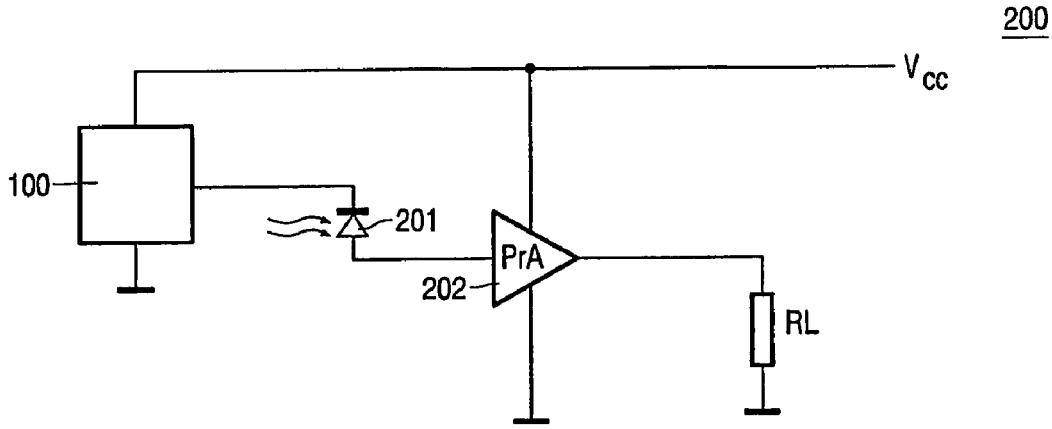
Figure 6:
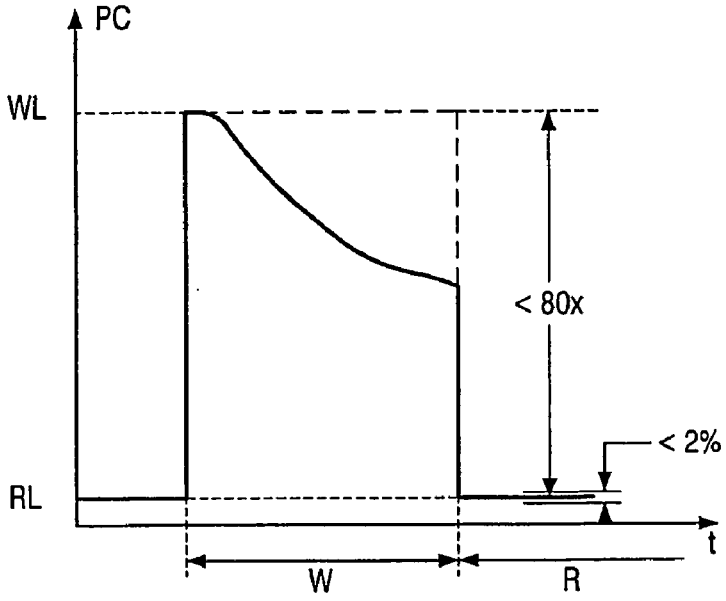
Figure 8:
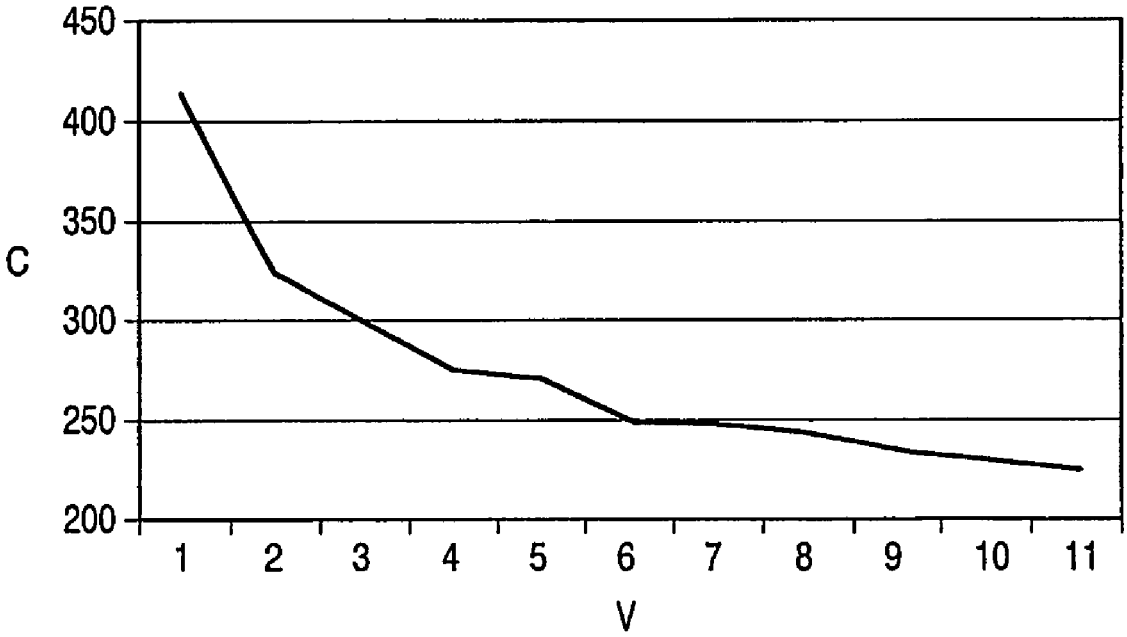

The above and other features and advantages of the invention will be apparent from the following description of the exemplary embodiments of the invention with reference to the accompanying drawings, in which:

FIG. 1 depicts an embodiment of a low dropout voltage regulator having a low output impedance according to the invention, FIG. 2 depicts an implementation of a first low-pass filter, according to an embodiment of the invention, FIG. 3 depicts an implementation of a second low-pass filter, according to an embodiment of the invention, FIG. 4 depicts an implementation of a selectable series-regulating element, according to an embodiment of the invention, FIG. 5 depicts an implementation of an optical detector/amplifier, according to an embodiment of the invention, FIG. 6 depicts a typical dependency between the photo—current of the PDIC and the WRITE/READ process, FIG. 7 depicts a prior art implementation of the first low-pass filter, and FIG. 8 depicts a typical characteristic capacity versus reverse voltage of a photo diode used in an optical detector/amplifier according to one embodiment of the invention.

FIG. 1 depicts an embodiment of a low dropout voltage regulator 100 according to the invention. The voltage regulator 100 comprises a series-regulating element T1 between an input I and an output O of the voltage regulator. The low dropout voltage regulator 100 includes a differential input error amplifier 1 having a first output O1 coupled to a control input of the series-regulating element T1 via a first amplifier 4. The first amplifier A1 may have an amplification factor of 1. A series connection of a capacitor Cn1 and a resistor Rn1 are preferably coupled between the first output O1 of the error amplifier and the output O of the voltage regulator to increase stability. The capacitor Cn1 may have a capacitance value of 2 pF. A capacitor C4 and a bias current source Ibias are coupled between the output O of the error amplifier and ground. The capacitor C4 may have a capacitance of 80 pF. The error amplifier 1 further comprises a second output O2 coupled to the output O via a high-pass filter. In this embodiment, the high-pass filter comprises a second amplifier 5, which may have an amplification factor of 1, coupled to a series combination of a first capacitor C1 and a first resistor R1. The resistor R1 may not be necessary. The amplifiers 4 and 5 may be left out if output stages of the error amplifier 1 are designed suitably.

The embodiment of FIG. 1 is a 'split band' structure with a PMOST series transistor T1 driven by amplifier A1, supported by a capacitive branch C2 driven by amplifier A2. DC and low frequencies are taken care off by T1 while class AB amplifier A2 via C2 takes care of the high frequencies. Both branches are controlled in parallel from error amplifier 1. The structure allows lowest voltage drop between input and output, governed by T1. As set out below with reference to FIG. 3, the reference to the error amplifier 1 is the supply voltage, reduced with a small DC voltage 'Vdrop' and filtered by a low-pass filter consisting of R1 plus C1. Since gain of the PMOST transistor T1 highly depends on Drain-Source DC current, a fixed bias Ibias ensures a certain minimum gain also with no light on the photo diodes. Empirically, it was found that a pre-filter 3 (that may be as simple as in FIG. 7) is still advantageous to obtain good overall filter suppression. Like the prior art solution, this simple implementation of the low-pass filter 3 uses a resistor R that is adapted in value in accordance with the current requirement. The available voltage drop 'Vdrop' is shared equal parts by pre-filter 3 and PMOST T1.

Passive filters normally used in low dropout voltage regulators are not fit for use in read/write applications having stringent requirements. An active filter as in U.S. Pat. No. 5,434,535 could also be considered. In that prior art patent a differential amplifier is used that has a feedback capacitor, the capacity of the capacitor being magnified by an amplification of the amplifier. Providing a correct biasing for the amplifier, the filter works properly for filtering relatively high frequency signals but is limited at relative low frequency by the output voltage excursion capability of the amplifier.

The applications requiring read/write operations on an optical disk could be CD, DVD, Blue-ray Disk (BD). In these applications a photo-detector integrated circuit (PDIC) is provided. The PDIC is used for monitoring a write process. Directly following a high intensity write laser pulse, a low intensity read out is necessary as it is shown in FIG. 6. The low intensity read outs contain mostly servo-control information, including a wobble signal. The PDIC photo diode has to recover from the write pulse fast enough for providing a sufficient accuracy in subsequent read operation. The settling time, amplitude and phase are determined by bandwidth and flatness response versus frequency. These requirements determine restrictions for the magnitude of the output impedance of the filter. Using a passive filter as shown in FIG. 7 in the above-mentioned conditions, the filter suppression requirements associated to high gain settings conditions are no longer met. In order to comply with these requirements the low dropout voltage regulator shown in FIG. 1 could be used. Hence, a first low-pass filter 3 coupled between the input I and the main current channel of the selectable series-regulating element T1, is used. DC and low frequency signals are filtered by the series-regulating element T1 controlled by the first amplifier 4. The class AB second amplifier 5 coupled in series to the first capacitor C1 and the first resistor R1 filter high frequency components. The circuit allows a relatively lower voltage drop between the input I signal Vcc and the output O signal VOUT.

An input+of the error amplifier 1 is coupled to a second low-pass filter 2, the second low-pass filter 2 being connected between the input I and a reference terminal. In an alternative embodiment, the second low-pass filter is absent, and the+input of the error amplifier 1 is coupled to a reference voltage source.

FIG. 2 depicts a preferred implementation of the first low-pass filter LPF 1, according to an embodiment of the invention. The first low-pass filter 3 comprises a first plurality of resistors R2*a*, R2*b*, R2*c* connected in series coupled to a first plurality of respective switches T2*a*, T2*b*, T2*c* for modifying a time constant of the first low-pass filter 3. In FIG. 2 the switches are represented as P-MOS transistors but a skilled person in the art could also imagine the use of other switching elements as e.g. N-MOS transistors, phototransistors or passive switches. Furthermore, control signals S2*a*, S2*b* and S2*c* are considered to be voltages but currents and light could be also be used and a skilled person in the art could easily derive a suitable circuit. When a switch T2*a*, *b* or *c* is in an ON state, its equivalent resistance in relatively low, much lower than a value of the resistance of any resistor R2*a*, *b* or *c*. When a switch T2*a*, *b* or *c* is in an OFF state, it's equivalent resistance in relatively big, much bigger that a value of the resistance of any resistor R2*a*, *b* or *c*. It results that when all the switches are in an OFF state the equivalent resistance of the circuit is R2*a*+R2*b*+R2*c*+R2*d* and a time constant of the filter is (R2*a*+R2*b*+R2*c*+R2*d*)*C2. If T2*a* is ON the equivalent resistance of the circuit is R2*b*+R2*c*+R2*d* and, consequently, the time constant of the filter is (R2*b*+R2*c*+R2*d*)*C2. Similar reasoning could be used for any combination of ON state switch—OFF state switch. Hence, the cut-off frequency of the low-pass filter could be adapted taking into account the technical constraints of an application, allowing more flexibility in applications.

FIG. 3 depicts an implementation of a second low-pass filter LPF2, according to an embodiment of the invention. The second low-pass filter 2 comprises a series coupling of a voltage source Vdrop, a second resistor R3 and a second capacitor C3 between the input In and a reference node Ref. The second low-pass filter delivers a reference signal to the error amplifier 1. The reference signal is obtained after a low-pass filtering of the signal Vcc inputted to the input I of the low dropout voltage regulator 100 after reducing it with a relatively small voltage Vdrop. The voltage Vdrop could be obtained using e.g. a bipolar junction transistor connected as a diode or as a fixed bias current through a resistor. The reduced signal is fuirther low-pass filtered by the series combination of the second resistor R3 and second capacitor C3. The voltage on the second capacitor C3 is inputted to the error amplifier 1 as reference voltage.

FIG. 4 depicts an implementation of a selectable series-regulating element T1, according to an embodiment of the invention. The selectable series-regulating element T1 comprises a plurality of series-regulating elements T1*a*, T1*b*, T1*c* coupled to a respective second plurality of selectable resistors R11*a*, R12*a*, R11*b*, R12*b*, R11*c*, R12*c*. The second plurality of selectable resistors R11*a*, R12*a*, R11*b*, R12*b*, R11*c*, R12*c* are P-MOS transistors coupled in pairs. Each pair comprises a series connection of a main current channels of two transistors coupled either between the input I and an output of the first amplifier 4 or between an output of the first low-pass filter 3 and the output of the first amplifier 4. It is understood that the controllable resistors could be also N-MOS transistors or phototransistors. Control signals S1*a*, S1*b* and S1*c* are considered voltages but skilled persons in the art could also imagine current signals or light signals. The selectable resistors R11*a*, R12*a*, R11*b*, R12*b*, R11*c*, R12*c* have a high resistance state and a low resistance state. When the resistors are in a high resistance state the respective series-regulating transistor T1*a*, *b* or *c* does not conduct a current through it's main current channel. Actually, a very low leakage current circulates through the main channel of the transistors. When the resistors are in a low resistance state the respective series-regulating transistor T1*a*, *b* or *c* does conduct a current through it's main current channel, supplying an output current Ibias.

FIG. 5 depicts an implementation of an optical detector/amplifier 200, according to an embodiment of the invention. The optical detector/amplifier 200 comprises a low dropout voltage regulator 100 for supplying one or more photo diodes 201 coupled to a variable gain amplifier 202. The photo diode(s) 201 transmits a signal corresponding to a read or a write operation on or from an optical disc. The variable gain amplifier comprises a plurality of cascaded-connected controllable amplifiers. The low dropout voltage regulator 100 has to supply the photo-diode (s) 201, the photo-diode(s) 201 receiving an optical signal generated by e.g. laser. The dependence of the photo—current in the photo-diode(s) 201 versus the optical signal is shown in FIG. 6 and a typical characteristic capacity versus reverse voltage of a photo diode(s) 201 used in an optical detector/amplifier is shown in FIG. 8. The low dropout voltage regulator 100 according to this invention is suitable to be used in applications using this kind of diodes and signals associated to as it was previously shown. An output signal of the photo-diode(s) 201 is amplified in a variable gain amplifier 202 that is necessary to adapt the signal to a load. Depending on a specific application, there could be one amplifier 202 or a plurality of amplifiers 202.

In summary, a low power, low dropout supply filter exhibiting low noise and low output impedance is created. Operated in closed loop the PMOST series transistor T1 supplies output power for DC and low frequencies, while the capacitively coupled class AB amplifier output stage 5 provides power for the high frequencies (up to 200 MHz). The fixed output parallel capacitor C4 takes over from there. By proper choice of components a smooth transition of operation over the three frequency regions is obtained. The circuit is used in PDIC amongst others to reduce cross-talk and to meet stringent settling requirements.

It is remarked that the scope of protection of the invention is not restricted to the embodiments described herein. Neither is the scope of protection of the invention restricted by the reference numerals in the claims. The word 'comprising' does not exclude other parts than those mentioned in the claims. The word 'a(n)' preceding an element does not exclude a plurality of those elements. Means forming part of the invention may both be implemented in the form of dedicated hardware or in the form of a programmed purpose processor. The invention resides in each new feature or combination of features.

The invention claimed is:

1. A voltage regulator comprising a series-regulating element (T1) between an input (I) and an output (O) of the voltage regulator, and a differential input error amplifier (1) having a first output (O1) coupled to a control input of the series-regulating element (T1), characterized in that the error amplifier (1) further comprises a second output (O2) coupled to the output (O) via a high-pass filter (5, R1, C1).

2. A voltage regulator as claimed in claim 1, wherein a first low-pass filter (3) is coupled between the input (I) of the voltage regulator and an input terminal of the series regulating element (T1).

3. A voltage regulator as claimed in claim 2, wherein the first low-pass filter (3) comprises a first plurality of resistors (R2*a*, R2*b*, R2*c*) connected in series, the first plurality of resistors (R2*a*, R2*b*, R2*c*) being coupled to a first plurality of respective switches (T2*a*, T2*b*, T2*c*) for modifying a time constant of the first low-pass filter (3).

4. A voltage regulator as claimed in claim 1, wherein a first input (+) of the error amplifier (1) is coupled to the input (I) of the voltage regulator through a second low-pass filter (2).

5. A voltage regulator as claimed in claim 4, wherein the second low-pass filter (2) comprises a series coupling of a voltage source (Vdrop), a resistor (R3) and a capacitor (C3).

6. A voltage regulator as claimed in claim 1, wherein the series-regulating element (T1) comprises a plurality of series-regulating elements (T1*a*, T1*b*, T1*c*) coupled to a respective second plurality of selectable resistors (R11*a*, R12*a*, R11*b*, R12*b*, R11*c*, R12*c*).

7. A voltage regulator as claimed in claim 6, wherein the second plurality of selectable resistors (R11*a*, R12*a*, R11*b*, R12*b*, R11*c*, R12*c*) are field effect transistors coupled in pairs, each pair comprising a series connection of a main current channels of two transistors coupled between the input (I) of the voltage regulator and the first output (O1) of the error amplifier (1).

8. An optical detector/amplifier (200) comprising a voltage regulator as claimed in any of the preceding claims for supplying one ore more photo diodes (201) coupled to a variable gain amplifier (202).

9. An optical detector/amplifier (200) as claimed in claim 8, wherein the variable gain amplifier comprises a plurality of cascaded-connected controllable amplifiers.

* * * * *